US005078042A

United States Patent [19]

Jensen

[11] Patent Number: 5,078,042

[45] Date of Patent: Jan. 7, 1992

[54] ELECTROMAGNETIC RAIL GUN

[75] Inventor: Daniel B. Jensen, Albuquerque, N. Mex.

[73] Assignee: The United States of America as represented by the Secretary of the Air Force, Washington, D.C.

[21] Appl. No.: 549,347

[22] Filed: Jul. 6, 1990

[51] Int. Cl.[5] ..... F41B 0/6

[52] U.S. Cl. ..... 89/8; 104/292; 124/3

[58] Field of Search ..... 89/8; 104/282, 290, 104/292, 294; 124/3; 310/12

[56] References Cited

U.S. PATENT DOCUMENTS

| | | | |
|---|---|---|---|
| 1,370,200 | 3/1921 | Fauchon-Villeplee | 124/3 |
| 1,422,427 | 7/1922 | Fauchon-Villeplee | 124/3 |
| 4,433,608 | 2/1984 | Deis et al. | 89/8 |
| 4,480,523 | 11/1984 | Young et al. | 89/8 |
| 4,677,895 | 7/1987 | Carlson et al. | 89/8 |
| 4,930,395 | 6/1990 | Loffler | 89/8 |

OTHER PUBLICATIONS

Beno et al., "An Investigation Into The Potential For Multiple Rail Railguns", IEEE Transactions on Magnetics, vol. 25, No. 1, Jan. 1989, pp. 92–96.

*Primary Examiner*—Stephen C. Bentley

*Attorney, Agent, or Firm*—William G. Auton; Donald J. Singer

[57] ABSTRACT

A quad armature electromagnetic rail gun uses four conducting rails, in a quadri-pole configuration, with four sliding armatures to propel projectiles. Two of the four conducting rails are positive, and receive one-half of the operating current. The four sliding armatures are slidably disposed between the two positive conducting rails and the two negative conducting rails, and each sliding armature conducts one-quarter of the conducting current therebetween. The quadruple configuration produces a minimum of magnetic interference at the center of the rail gun so that projectiles with electronic components need a minimum of magnetic shielding.

12 Claims, 2 Drawing Sheets

ELECTROMAGNETIC RAIL GUN

BACKGROUND OF THE INVENTION

The present invention relates generally to electromagnetic projectile launching systems, and more particularly to electromagnetic rail guns.

Electromagnetic projectile launchers include rail gun systems. Such systems normally use a pair of conductive rails, a sliding conductive armature between the rails, a source of high current, and a means of commutating this current into the rails and through the armature. This places an electromagnetic force on the armature and propels it along the conductive rails. By placing a projectile in front of the armature and activating the rail gun, the projectile is propelled by the movement of the armature.

Exemplary in the art of electromagnetic projectile launching systems are the systems described in the following U.S. Patents, the disclosures of which are incorporated herein by reference:

U.S. Pat. No. 1,370,200 issued to Fauchon-Villeplee;
U.S. Pat. No. 1,422,427 issued to Fauchon-Villeplee;
U.S. Pat. No. 4,433,608 issued to Deis et al; and
U.S. Pat. No. 4,480,523 issued to Young et al.

The early Fauchon-Villeplee patent No. 1,3700,200 disclosed an electric gun for propelling projectiles having conductive wings. A cross-shaped projectile is shown in the later Fauchon-Villeplee patent No. 1,422,427. In this early design, the projectile and armative were one and the same. However, the more modern approach used a separate armature to launch projectable so that they are not constrained to have conductive wings. This modern approach is more suitable to the present need, since the modern projectiles may have complex electronic circuitry and they are more than inert payloads or explosives, as envisioned in the past.

Deis et al and Young et al are excellent examples of modern rail gun systems. Deis et al show a rail gun with elements having a rectangular cross-section. Young et al show a multiple rail, multiple armature construction in which armatures carried by a cylindrical core are located between the rails.

The systems of Deis et al and Young et al free the projectiles from the constraints of the Fauchon-Villeplee references. However, a recently developed concern entails the task of magnetically shielding modern projectiles from the magnetic field used in rail guns. As hinted earlier, modern projectiles may be more than inert payloads. These projectiles may have complex electronic circuitry of their own for a number of tasks that they perform. While magnetically shielding modern projectiles is a solution to this concern, shielding alone is an inadequate approach, for the reason discussed below.

Magnetic shielding of electronic components from magnetic fields commonly entails imposing a shield (often of a ferrous material) between the components and the magnetic field. The stronger the field, the more shielding may be required to reduce the magnetic field to a threshold that doesn't interfere with the electronic component. The task of shielding projectiles from the magnetic fields used in rail guns is made easier if the magnetic field is reduced. Also, the weight of the shielding may be reduced if the magnetic field is reduced.

From the foregoing discussion, it is apparent that there currently exists the need to reduce the level of magnetic fields of electromagnetic rail guns. The present invention is intended to satisfy the need.

SUMMARY OF THE INVENTION

The present invention is an electronic rail gun which uses four conducting rails which are configured in a quadri-pole configuration. These conductive rails are capable of accelerating four conductive orthogonal armatures which slide along the rails when currents in the rails product magnetic fields.

The conducting rails are in a true quadra-pole configuration with current going into and out of opposing rails and the projectile armatures are located between these rails. The current into the gun is split, with one-half going into each positive rail, one-fourth going across each armature and one-half the current coming out of each negative rail. The lower magnetic field at the center of the projectile makes it easier to shield projectiles which carries electronic packages.

It is an object of the present invention to provide an electromagnetic projectile launching system which subjects projectiles to reduced amounts of magnetic fields.

It is another object of the present invention to provide an electromagnetic rail gun in which four orthogonal armatures are accelerated by four conducting rails which are configured in a quadri-pole configuration.

These together with other objects, features and advantages of the invention will become more readily apparent from the following detailed description when taken in conjunction with the accompanying drawings wherein like elements are given like reference numerals throughout.

DESCRIPTION OF THE DRAWINGS (U)

DETAILED DESCRIPTION OF THE PREFERRED EMBODIMENT

The present invention is an electromagnetic projectile launching system which uses four conducting rails, which are configured in a quadri-pole configuration, to accelerate four conductive orthogonal armatures to launch projectiles.

Figure 1:
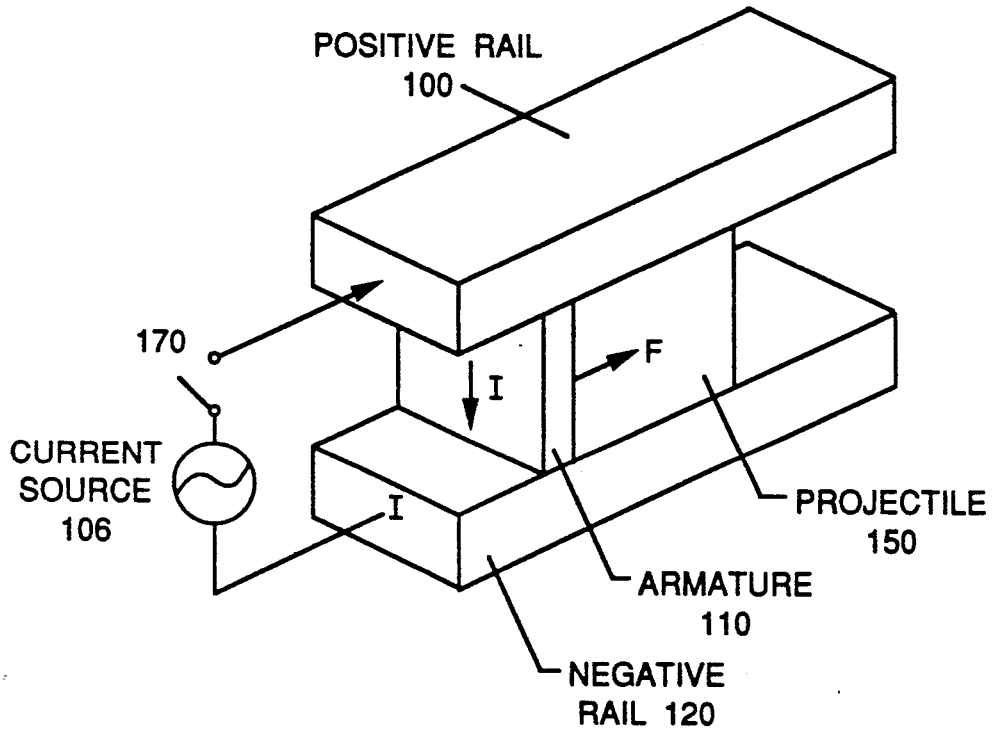
FIG. 1 PRIOR ART
FIG. 1 is an illustration of a prior art rail gun.

The reader's attention is now directed towards FIG. 1, which is an illustration of a prior art electromagnetic rail gun. The rail gun of FIG. 1 uses a positive rail 100, a sliding armature 110, and a negative rail 120 to accelerate a projectile 150. As illustrated in FIG. 1, a high current I from a generator 160 enters the positive rail 100, and is conducted through the sliding armature 110 and negative rail 120 to produce a strong magnetic field which drives the sliding armature 110 forward.

Figure 2:
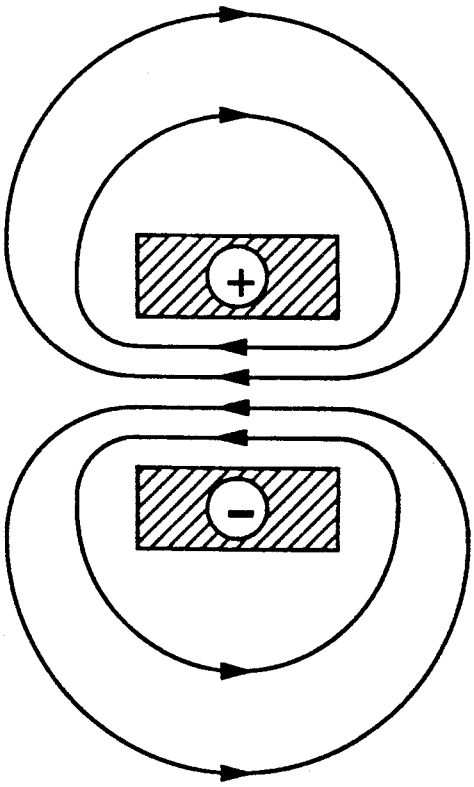
FIG. 2 PRIOR ART
FIG. 2 is an end view of the rail gun of FIG. 1, and it depicts the magnetic fields with respect to current direction.

FIG. 2 is an end view of the rail gun FIG. 1. The purpose of FIG. 2 is to illustrate how the current direction in the positive rail 100 and the negative rail 120 produces magnetic fields that work in concert with each other.

The system of FIG. 1 is well-known in the art, as exemplified by the Deis et al and Fauchon-Villeplee references. As mentioned above, the use of the high current I produces an extremely strong magnetic field to accelerate the projectiles. When these projectiles are inert constructs or simple chemical explosives, such prior art designs are more than adequate to simply propel projectiles. However, when the projectile contains electronic components, it is difficult to shield them from the effect of the high current I.

Figure 3:
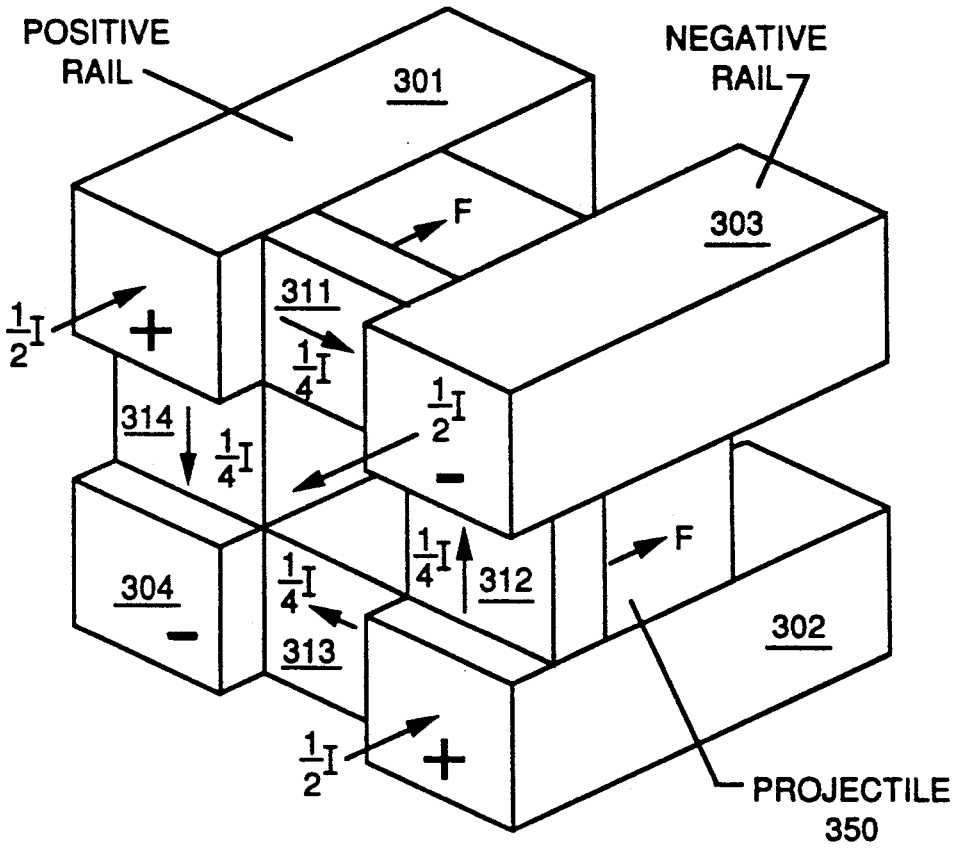
FIG. 3 is an illustration of an embodiment of the present invention.

FIG. 3 of an embodiment of the present invention. The electronic rail gun of FIG. 3 uses four conducting rails 301–304, which are configured in a quadri-pole configuration, to accelerate four conductive orthogonal armatures 311–314 to launch projectiles. The four conductive rails included two positive rails 301, 302, into which currents of ½ I are input, and two negative rails 303, 304 out of which currents of ½ I are received.

The four conductive orthogonal armatures 311–314 each conduct current of ¼ between a positive rail and a negative rail. Like the system of FIG. 1, these armatures slide along the positive and negative rails when accelerated by the magnetic field. However, while the armature of FIG. 1 conducts a current of level I, the four conductive armatures each conduct a current of ¼ I.

Note that the source of high current for the present invention is similar to those presented in the cited references, and need not be discussed in further detail. Similarly, each of the conducting armatures 311–314 is slidably disposed with respect to the conducting rails in the manner of the Deis et al reference.

In operation, the four conducting rails each generate a propelling magnetic field when conducting an operating current from the current source. Similarly the conducting armature experience on electromotive force in the presence of the propelling magnetic fields when they conduct the operating current between the rails. However, as discussed below, the system of FIG. 3 is not merely a multiple aggregation of FIG. 1 systems. FIG. 3 is designed to produce magnetic fields that work in concert with regards to propelling a projectile, but are orthogonal with respect to each other at one particular location. This particular location is relatively free of magnetic interference and is discussed in detail below. As in the preceding rail guns, the sliding armatures are physically in contact with the projectile and propel it by their own motion. To accomplish this, the projectile may be a cross-shaped projectile as shown in the Fauchon-Villeplee patent 1,422,427, or the armatures may have an insulating mechanical connection between them.

Figure 4:
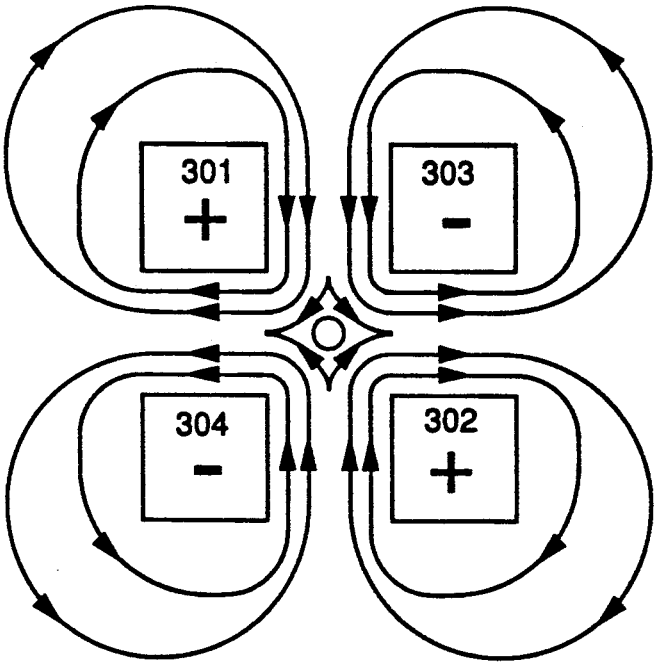
FIG. 4 is an end view of the rail gun of FIG. 3 which shows the magnetic fields produced by a quadri-pole configuration.

FIG. 4 is an end view of the electronic rail gun of FIG. 3. The purpose of FIG. 4 is to illustrate how the current directions of the four conducting quadri-pole rails 301–304 produce magnetic fields that work in concert with each other The use of the four conducting rails 301–304 quadri-pole configuration, in conjunction with the four orthogonal armatures, produces a lower magnetic field in the center of the rail gun, than is produced by the prior art rail gun of FIG. 1. This lower magnetic field is easier to shield against, which is an advantage when the projectile has an electronic package enclosed which is susceptible to surrounding magnetic fields. Magnetic fields are generally capable of inducing voltages in electronic systems and, in some instances, can even damage them.

As illustrated in FIG. 4, both positive conducting rails 301 and 302 have magnetic fields with left hand circular polarization. The end view of these rails depicts a magnetic circuit in which the flux path is clockwise. The negative conducting rails have magnetic fields with right hand circular polarization. The end view of these rails depicts a magnetic circuit in which the flux paths are counter clockwise. At the very center of the four conducting rails an the conducting armatures, all four magnetic fields are orthogonal, and there exists a center section which is relatively free of magnetic interference. When all four conductive orthogonal armatures 311–314 are propelled in concert, they may propel a single projectile which fits within this center section. Since the center section area has reduced magnetic interference, electronic components housed in the projectile require an amount of magnetic shielding that is significantly reduced when compared to that needed with the rail gun of FIG. 1. Magnetic shielding is briefly discussed below.

Well-engineered circuits are often affected by extraneous magnetic fields, which can be eliminated to some degree by properly shielding the components. The magnetic shield is a low-reluctance path in which the field is concentrated or "trapped." For this reason magnetic shields a-e generally made of a high-permeability nickel-iron alloy such as MUMETAL, PERMALLOY 80 or ARMCO 48 Alloy. The first two materials provide maximum shielding at low flux densities; the last is best at higher flux densities. Cast iron and materials provide maximum shielding at low flux densities; the last is best at higher flux densities. Cast iron and materials of relatively low permeability have been used but their low permabilities must be offset by using heavier thicknesses.

Design formulas for determining the proper thickness of a shield are given in current literature. These formulas generally pertain to ideal shapes which are seldom encountered in practice. For example, most nickel-iron shields used for shielding transformers, cathode-ray and photomultiplier tubes, etc., are generally produced in thicknesses of 0.025–0.035 in. In some instances 0.014 in. has been used successfully; other designs have required as much as 0.060 in. In addition to the thickness required for adequate shielding one must also allow sufficient thickness for rigidity, particularly when shielding moving projectiles such as those accelerated by the rail gun of the present invention.

The projectiles used with the rail gun should be encapsulated with a nickel-iron alloy when they house electronic circuits. But the thickness of this shielding is much less than the amount needed when using the prior art rail gun of FIG. 1. The invention, as depicted in FIG. 3 may be termed a quad armature electromagnetic rail gun, because the four rails have a quadri-pole configuration, and the four armatures are orthogonal. The total impedance of the quad armature electromagnetic rail gun is lower than that of the equivalent conventional rail guns in the design of FIG. 1. A single rail gun, of the design of FIG. 1 has a total impedance given by the sum of the impedances of: a positive rail, an armature, and a negative rail (in a series circuit). The FIG. 3 embodiment of the invention has four of these series impedances which are in a parallel circuit. With a lower overall impedance, the system of FIG. 3 has improved efficiency when compared to its functional equivalent produced by multiple rail guns having the configuration of FIG. 1.

The quad armature rail gun of FIG. 3 is known as the Multiple Armature/Rail Configuration IV (MARC IV) and has been built for comparison with a MARC I rail gun (as depicted in FIG. 1). In construction, the armatures are composed of aluminum, while the rails may be copper or a 1% chrome-copper alloy. The insulator was composed of a commercially available product known as LEXAN.

The results of the test of the MARC I are presented below in Table 1, while the results of the list of the MARC IV are presented in Table 2. Each table lists the theoretically expected characteristics under the column labeled "Theory" and the measured results under "EXPT."

TABLE 1

| MARC-I PERFORMANCE | | |
|---|---|---|
| PARAMETER | EXPT. | THEORY |
| Bank Voltage, $V_O$ (V) | 500 | 500* |
| Bank Capacitance, $C_O$ (F) | 0.336 | 0.336* |
| Power Supply Inductance, $L_O$ (nH) | 205 | 250* |
| Power Supply Resistance, $R_O$ ($\mu\Omega$) | 265 | 265* |
| Injection Velocity, $U_O$ (m/s) | 504 | 504* |
| Projectile Mass, $m_p$ (g) | 5.86 | 5.86* |
| Gun L' ($\mu$H/m) | — | 0.364 |
| Foil Mass, $m_f$ (g) | 0.05 | |
| Armature Mass, $m_a$ (g) | — | 0.01 |
| Muzzle Voltage, Vm (V) | 200 | 200 |
| Maximum Current, $I_{max}$ (kA) | 220 | 250 |
| Max Breech Voltage, $V_B$ (V) | 310 | 286 |
| Muzzle Velocity, $U_m$ (km/s) | 1.08 | 1.35 |
| Armature Length, $l_a$ (cm) | — | 2.81 |
| Peak Plasma Temp, $T_{max}$ (K) | — | 49,700 |

*Input Parameters for Model

TABLE 2

| MARC IV PERFORMANCE | | |
|---|---|---|
| PARAMETER | EXPT. | THEORY |
| Bank Voltage, $V_O$ (V) | 500 | 500* |
| Bank Capacitance, $C_O$ (F) | 0.336 | 0.336* |
| Power Supply Inductance; $L_O$ (nH) | 205 | 250* |
| Power Supply Resistance, $R_O$ ($\mu\Omega$) | 265 | 265* |
| Injection Velocity, $U_O$ (m/s) | 504 | 504* |
| Projectile Mass, $m_p$ (g) | 6.25 | 6.25* |
| Gun L' ($\mu$H/m) | — | 0.104 |
| Foil Mass, $m_f$ (g) | 0.05 | — |
| Armature Mass, $m_a$ (g) | — | 0.01+ |
| Muzzle Voltage, $V_m$ (V) | — | 75 |
| Maximum Current, $I_{maX}$ (kA) | 350 | 380 |
| Max Breech Voltage, $V_B$ (V) | 160 | 116 |
| Muzzle Velocity, $U_m$ (km/s) | 0.98 | 1.1 |
| Armature Length, $l_a$ (cm) | — | 2.65 |
| Peak Plasma Temp, $T_{max}$ (K) | — | 37,200 |

*Input Parameters For Model
+Chosen to Match Muzzle Voltage for Marc-I

A comparison of the characteristics of the MARC I rail gun versus the characteristics of the MARC IV is presented below in Table 3.

TABLE 3

| (U)SCALING LAW COMPARISON OF MARC-I AND MARC-IV | | |
|---|---|---|
| PARAMETER | MARC-I | MARC-IV |
| No. of Armatures | 1 | 4 |
| L'($\mu$H/M) | 0.364 | 0.104 |
| Total Current | $I_o$ | $I_o$ |
| Current/Armature | $I_o$ | $\frac{I_O}{4}$ |
| Voltage Drop/Armature | $I_O \frac{\eta}{L_A}$ | $\frac{I_O\eta}{4L_A}$ |
| Ohmic Loss/Armature | $I_O^2 \frac{\eta}{L_A}$ | $\frac{I_O^2\eta}{16L_A}$ |
| Dielectric Area/Armature | $2HL_A$ | $\frac{HL_A}{2}$ |
| Rail Area/Armature | $2HL_A$ | $HL_A$ |

TABLE 3-continued

| (U)SCALING LAW COMPARISON OF MARC-I AND MARC-IV | | |
|---|---|---|
| PARAMETER | MARC-I | MARC-IV |
| Total Ohmic Loss | $I_O^2 \frac{\eta}{L_A}$ | $\frac{I_O^2\eta}{4L_A}$ |
| Total Bore Area | $4HL_A$ | $6HL_A$ |
| Radiation Flux | $\frac{I_O^2\eta}{4HL_A^2}$ | $\frac{I_O^2\eta}{24HL_A^2}$ |

From the experimental results of Tables 1 and 2 as well as the scaling comparisons of Table 3, the following generalizations may be made in comparing the performance of the NARC IV with the MARC I. First, the gun inductance (L' in H/meter) is considerably less in the MARC IV than in the MARC I. The MARC IV operates at a higher current, for the same bank voltage than does the MARC I (due to the lower armature resistance and L' of the MARC IV).

The net accelerating force is approximately the same for both geometries. However, the projectiles launched from the MARC IV require considerably less magnetic shielding when they contain electronic components which need to be protected from the influence of magnetic fields.

The MARC IV model, which was developed for test purposes, was capable of launching projectiles with a muzzle velocity of 980 meters/second. However this model is just an example of the invention which is not limited to just the materials and operating characteristics of this example.

The present invention has been described in terms of being an electromagnetic rail gun which propels a projectile. In a larger sense, the invention may be regarded as an electromagnetic propulsion system which propels a compartment. The reason for this distinction is that the fi--st description seems limited to weapon systems, while the second definition can include commuter rail systems which use magnetic propulsion in place of mechanical electric motors.

Magnetic commuter rail systems are used i n Japan, and the present invention is believed to be important improvement for the following reasons. Living organisms are susceptible to electromagnetic fields, and the federal OSHA administration has indicated that exposure to fields of more than 10 milliwatts per square centimeter is harmful to people. Since the present invention is configured to reduce the electromagnetic field at the location of the compartment, the present invention presents a design which may be useful to future commuter rail systems.

While the invention has been described in its presently preferred embodiment it is understood that the words which have been used are words of description rather than words of limitation and that changes within the purview of the appended claims may be made without departing from the scope and spirit of the invention in its broader respects.

What is claimed is:

1. A quad armature electromagnetic rail gun for use with an operating current from a current source for magnetically propelling a projectile, said quad armature electromagnetic rail gun comprising:

first, second, third and fourth conducting rails which are parallel with each other and fixed in proximity with each other in a quadri-pole configuration, said first and second conducting rails being electrically connected to said current source so that they each receive one half of said operating current, said third and fourth conducting rails each being electrically connected to said current source so that they each receive one half of said operating current from said current source, said conducting rails each generating a propelling magnetic field when conducting an electric current, and said quadri-pole configuration producing a minimum of magnetic interference on said projectile; and a means for conducting currents to said first and second conducting rails and to said third and fourth conducting rails, said conducting means being slidably disposed between said conducting rails such that it conducts said operating currents from said first and second conducting rials to said third and fourth conducting rails, said conducting means being propelled by an electromotive force by said propelling magnetic field when it conducts said operating current, said electromotive force enabling said conducting means to propel the projectile placed in front of it as the conducting means slides along said conducting rails, said conducting means having a center section where said propelling magnetic fields form said conducting rails are all orthogonal to each other due to said quadri-pole configuration, said center section having a relatively low level of magnetic interference which has a reduced effect on any electronic circuits when they are in projectiles in front of said center section; wherein said conducting means comprises: first, second, third and fourth sliding armatures, each conducting one quarter of said operating current while being propelled by said propelling magnetic field, said first second third and fourth sliding armatures being in contact with said projectile to propel it when accelerated by said propelling magnetic field.

2. A quad armature electromagnetic rail gun, as defined in claim 1, wherein said first sliding armature is slidably disposed between said first and said third conducting rail to conduct one quarter of said operating current there between while being propelled by said propelling electromagnetic field.

3. A quad armature electromagnetic rail gun, as defined in claim 2, wherein said second sliding armature is slidably disposed between said second and said third conducting rails to conduct one quarter of said operating current therebetween while being propelled by said propelling electromagnetic field.

4. A quad armature electromagnetic rail gun, as defined in claim 3, wherein said third sliding armature is slidably disposed between said second and said fourth conducting rails to conduct one quarter of said operation current therebetween while being propelled by said propelling electromagnetic field.

5. A quad armature electromagnetic rail gun, as defined in claim 4, wherein said fourth sliding armature is slidably disposed between said first and said fourth conducting rails to conduct one quarter of said operating current therebetween while being propelled by said propelling electromagnetic field.

6. A quad armature electromagnetic rail gun, as defined in claim 4, wherein said first, second, third and fourth sliding armatures are composed of aluminum and said first, second, third and fourth conducting rails are composed of copper.

7. A quad armature electromagnetic propulsion system for use with an operating current from a current source for magnetically propelling a compartment, said quad armature electromagnetic propulsion system comprising:

first, second, third and fourth conducting rails which are parallel with each other and fixed in proximity with each other in quadri-pole configuration, and first and second conducting rails being electrically connected to said current source so that they each receive one half of said operating current, said third and fourth conducting rails each being electrically connected to said current source so that they each receive one half of said operating current of said current source, said conducting rails each generating a propelling magnetic field when conducting an electric current, and said quadri-pole configuration producing a minimum of magnetic interference on said compartment; and a means for conducting currents to said first and second conducting rails and to said third and fourth conducting rails, said conducting means being slidably disposed between said conducting rails such that it conducts said operating current between said first and second conducing rail and said third and fourth conducting rails, said conducting means being propelled by an electromotive force by said propelling magnetic field when it conducts said operating current, said electromotive force enabling said conducting means to propel the compartment placed in front of it as the conducting means slides along said conducting rails, said conducting means having a center section where said propelling magnetic fields from said conducting rails are all orthogonal to each other due to said quadri-pole configuration, said center section having a relatively low level of magnetic interference which has a reduced effect on an electronic circuits and living organisms when they are in compartments in front of said center section, wherein said conducting means comprises: first, second, third and fourth sliding armatures, each conducting on quarter of said operating current while being propelled by said propelling magnetic field, said first second third and fourth sliding armatures being in contact with said compartment to propel ti when accelerated by said propelling magnetic field.

8. A quad armature electromagnetic propulsion system, as defined in claim 6, wherein said first sliding armature is slidably disposed between said first and said third conducting rail to conduct one quarter of said operating current there between while being propelled by said propelling electromagnetic field.

9. A quad armature electromagnetic propulsion system, as defined in claim 8, wherein said second sliding armature is slidably disposed between said second and said third conducting rails to conduct one quarter of said operating current therebetween while being propelled by said propelling electromagnetic field.

10. A quad armature electromagnetic propulsion system, as defined in claim 9, wherein said third sliding armature is slidably disposed between said second and said fourth conducting rails to conduct one quarter of said operation current therebetween while being propelled by said propelling electromagnetic field.

11. A quad armature electromagnetic propulsion system, as defined in claim 10, wherein said fourth sliding armature is slidably disposed between said first and said fourth conducting rails to conduct one quarter of said operating current therebetween while being propelled by said propelling electromagnetic field.

12. A quad armature electromagnetic propulsion system, as defined in claim 10, wherein said first, second, third and fourth sliding armatures are composed of aluminum and said first, second, third and fourth conducting rails are composed of copper.

* * * * *